United States Patent [19]

Kern

[11] 4,307,547

[45] Dec. 29, 1981

[54] SUSPENDED SHELVING STOREHOUSE

[76] Inventor: Helmut Kern, Hornrain 9, D-7889 Grenzach-Wyhlen, Fed. Rep. of Germany

[21] Appl. No.: 132,175

[22] Filed: Mar. 20, 1980

Related U.S. Application Data

[63] Continuation of Ser. No. 926,926, Jul. 7, 1978, abandoned, which is a continuation of Ser. No. 769,959, Feb. 18, 1977, abandoned, which is a continuation-in-part of Ser. No. 700,113, Jun. 28, 1976, abandoned.

[51] Int. Cl.[3] ..... G09F 7/18

[52] U.S. Cl. ..... 52/39; 108/149; 248/317; 248/243

[58] Field of Search ..... 52/39, 83; 248/243, 248/317, 327, 343; 108/149

[56] References Cited

U.S. PATENT DOCUMENTS

| | | | |
|---|---|---|---|
| 1,905,596 | 4/1933 | Lewis | 248/356 |
| 2,406,937 | 9/1946 | Zabriskie | 52/39 |
| 3,330,083 | 7/1967 | Janlmes | 248/317 |
| 3,396,502 | 8/1968 | Contevita | 52/83 |
| 3,990,665 | 11/1976 | Joussemet | 52/39 |
| 4,061,092 | 12/1977 | Jacobsen | 52/39 |

*Primary Examiner*—Price C. Faw, Jr.
*Assistant Examiner*—Henry E. Raduazo
*Attorney, Agent, or Firm*—Browdy and Neimark

[57] ABSTRACT

The invention concerns a suspended shelving storehouse construction comprising a foundation, spaced apart vertical columns rising from the foundation, a load-bearing ceiling supported by said vertical columns, a series of tension bars each secured to the load-bearing ceiling at spaced intervals between the vertical columns so that the tension bars are suspended substantially vertically from the ceiling between adjacent columns, and shelving girders mounted horizontally between adjacent tension bars.

7 Claims, 13 Drawing Figures

24

SUSPENDED SHELVING STOREHOUSE

This is a continuation of application Ser. No. 926,926 filed July 7, 1978 and now abandoned, which is a continuation of application Ser. No. 769,959 filed Feb. 18, 1977 and now abandoned which is in turn a continuation in part of application Ser. No. 700,113 filed June 28, 1976 and now abandoned.

STOREHOUSE CONSTRUCTION

The invention concerns a storehouse construction of the "high rise" type in which automatically or hand-controlled conveyer vehicles are provided for moving between rows of shelving for performing storage activities.

Advantageously, a high rise storehouse construction of the above type includes means whereby shelving may be adjusted in the vertical direction and most preferably horizontal adjustment of vertical shelving supports should also be possible so that the storehouse compartments can receive storage units of varying dimensions. The accuracy with which the shelving is mounted in the storehouse should also be greater than or independent of the accuracy with which the storehouse building elements are constructed. Furthermore, the shelving should be easily dismountable and the construction should be of low cost and easily constructed in a short time. Also of importance is that the construction should conform to safety regulations especially with regard to fire and earth tremors.

Most high rise storage constructions are constructed of steel frameworks which simultaneously serve as frameworks for shelving. The stability of such constructions is achieved by providing bracings along the axis of shelving members or within the facade. These types of constructions allow for a certain vertical adjustability in that holes may be drilled in the steel uprights and shelf girders may be accordingly displaced. However, no horizontal adjustability is possible since the uprights for the shelves simultaneously form a portion of the building construction. A steel construction is not fireproof, in that steel loses strength when temperatures reach 400° C. Even a warm steel column may buckle in case of fire and cause collapse of an entire range of shelving, with probable effects on other parts of the building not yet burning. Because of this, it may be too dangerous for a fire brigade to enter a building of steel construction in which there is fire.

It is an object of this invention to provide a storehouse construction which meets the abovementioned advantages and preferences and which is particularly designed to reduce the extent of damage which may be caused by fire. Also, the nature of the construction of the invention is such that damage should not occur in the event of earth tremors.

In accordance with the invention, there is provided a suspended shelving storehouse construction comprising a foundation, spaced apart vertical columns rising from the foundation, a load-bearing ceiling supported by said vertical columns, a series of tension bars each secured at one end to the load-bearing ceiling at spaced intervals between the vertical columns so that the tension bars are suspended substantially vertically from the ceiling between adjacent columns, and shelving girders mounted horizontally between adjacent tension bars.

Other features forming part of the present invention will be understood from the following description with reference to the accompanying drawings illustrating the invention by way of example.

In the drawings:

FIG. 1 shows a plan view of a portion of a storehouse construction in accordance with the invention;

FIGS. *2a* and *2b* show side sectional elevations of alternative free hanging and foundation anchored shelving constructions taken at II—II of FIG. 1;

Figure 1:
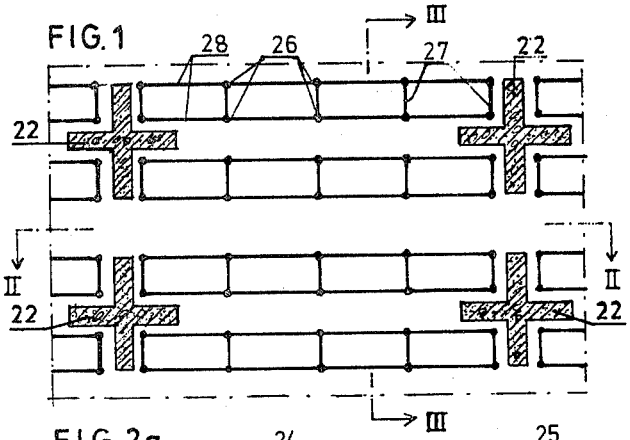

Referring to FIGS. 1, *2a*, *2b* and 3 of the drawings, the storehouse construction comprises a foundation 20, spaced apart vertical columns 22 rising from the foundation, a load-bearing ceiling 24 supported by said columns, a series of tension bars 26 each secured at one end 25 to the load-bearing ceiling at spaced intervals between the vertical columns 22, and shelving girders 28 mounted horizontally between adjacent tension bars 26. Reference numeral 27 refers to cross-members which are most preferably provided for maintaining a fixed spacing between each of a pair of adjacent parallel shelving girders 28.

In the side sectional elevation shown in FIG. *2b*, the bottom end of the tension bars are additionally secured to the foundation 20 by convention anchorage means and tensioned between the load-bearing ceiling 24 and foundation 20. The tensioning of the tension bars between the load-bearing ceiling serves to reduce elongation of the tension bars following on loading of shelving girders.

In that the period of oscillation of the tension bars and also the columns is great and very different to the period of dangerous earthquake oscillations, forces which are absorbed by the storehouse construction in the event of earthquake are small. The storehouse construction of the invention is accordingly extraordinarily capable of withstanding earthquakes.

It will additionally be appreciated from above that all loads are supported by the tension bars 26 which are in turn suspended from the load-bearing ceiling 24. Thus, there are no horizontal force components acting on the construction elements of the building, i.e. the foundation 20, columns 22 and load-bearing ceiling 24. These construction elements are most preferably of concrete to further reduce the likehood of damage in the case of fire.

The series of tension bars 26 may be secured to the load bearing ceiling 24 in the free hanging construction shown in FIG. *2a* at precisely measured spaced intervals so that the entire shelving construction comprising tension bars 26 and shelving girders 28 and most preferably cross-members 27 may be accurately constructed independently of inaccuracies of the construction elements of the building. Since the tension bars 26 are freely suspended, these will always be vertical and inclinations of the construction elements of the building such as may be caused by differences in soil consolidation and thus the foundation 20 and accordingly columns 22 and ceiling 24 will not influence the vertical orientation of the tension bars 26. This is of high practical advantage in that shelving girders 28 horizontally mounted between tension bars 26 will similarly always be horizontal.

Figure 4:
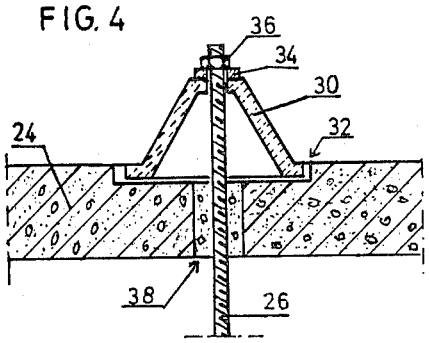
FIG. 4 shows a vertical cross section of one securing means for securing tension bars to the load bearing ceiling.
Figure 2A:
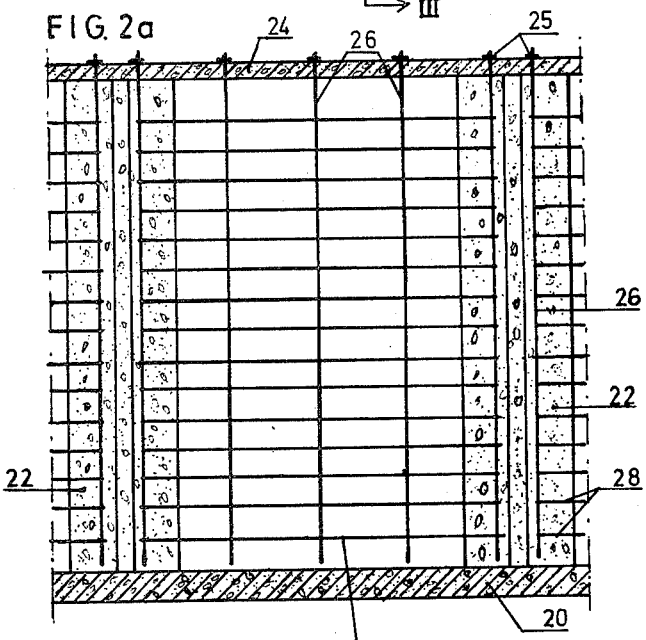
Figure 5:
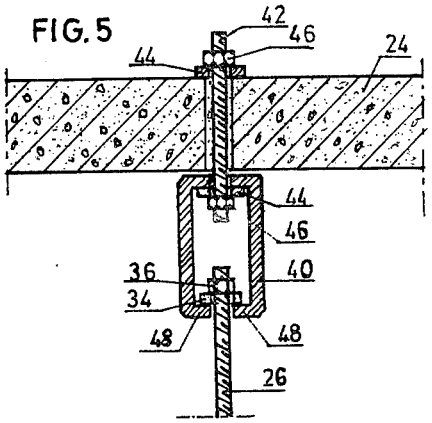
FIG. 5 shows a vertical cross section of another securing means for securing tension bars horizontally slideably to the load bearing ceiling.
Figure 2B:
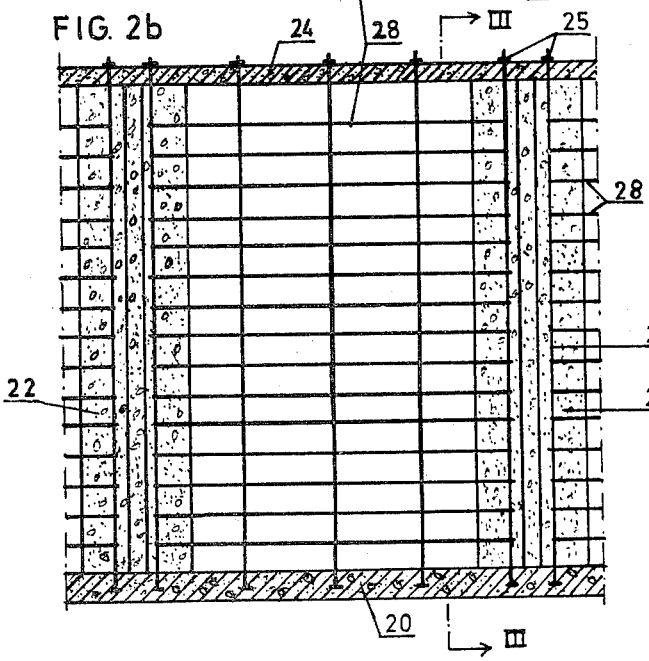
Figure 3:
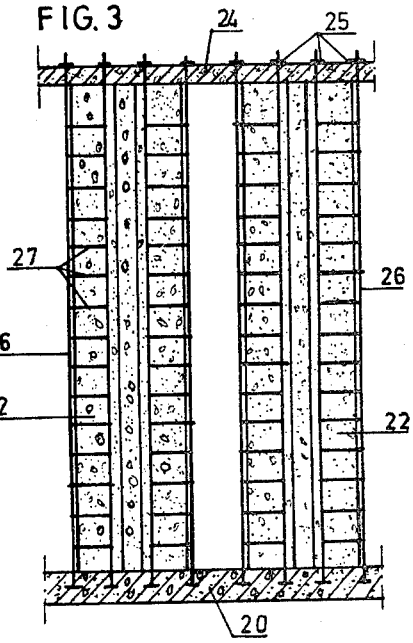
FIG. 3 shows an end sectional elevation taken at III—III of FIG. 1 or III—III of FIG. *2b;*
Figure 6:
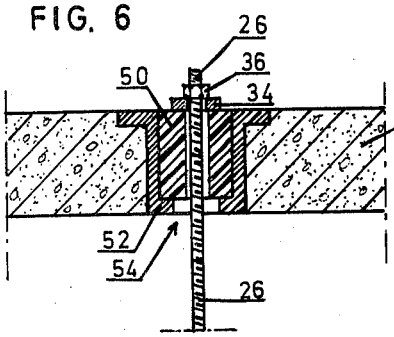
FIGS. 6 and 7 show vertical cross sections of yet further securing means for securing tension bars to the load bearing ceiling.
Figure 7:
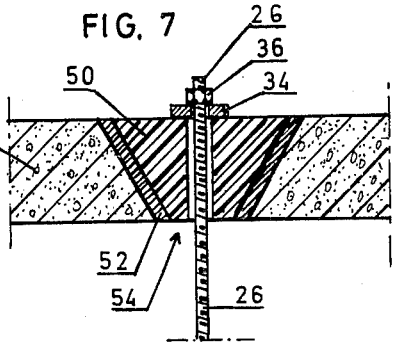

Referring now to FIG. 4, the securing means for securing tension bars 26 to the load-bearing ceiling 24 comprises a refractory element 30 in the form of a hollow open ended frustro-conical element. The load-bearing ceiling 24 is provided with a seat 32 into which the base of the refractory element fits. The tension bar 26 is screw-threaded and is supported by the refractory element by means of a washer 34 over the opening at the top of the refractory element and a mating screw-threaded nut 36 screwed onto the tension bar 26. The tension bar 26 passes through opening 38 in the load-bearing ceiling, which opening is larger than the washer 34 and nut 36 so that destruction of the refractory element 30 by an act of striking will result in the tension bar and shelving girders 28 falling to the ground. In this manner, burning portions of the building may be caused to fall to the ground where fire may be more easily extinguished. result in the tension bar 26 and its dependent shelving girders 28 falling to the ground where, as mentioned above, fire may be more easily extinguished.

Figure 8:
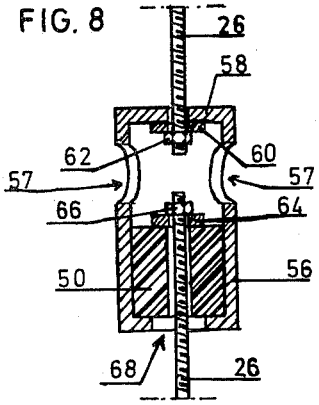
FIGS. 8 and 9 show vertical cross sections of connection means between adjacent shorter tension bars.
Figure 9:
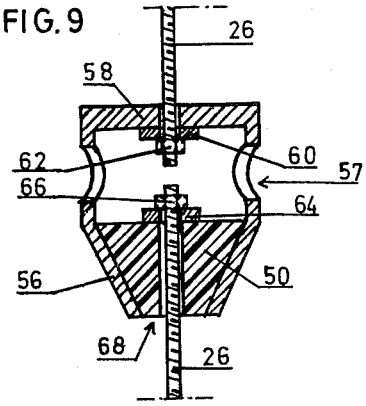

Each tension bar 26 may consist of a series of interconnected shorter tension bars, and FIGS. 8 and 9 show connection means between adjacent shorter tension bars. These connection means comprise heat deformable elements 50 which are mounted on the end of a shorter tension bar by means of cup-shaped elements 56 into which the heat deformable elements 50 fit. The cup-shaped elements have a top 58 to which the end of one shorter tension bar is secured by means of washer 60 and screw-threaded nut 62. The end of the adjacent shorter tension bar is connected to the heat deformable elements 50 by means of washer 64 and screw-threaded nut 66. The bottom of the cup-shaped elements 56 are provided with openings 68 larger in size than washer 64 whereby softening of the heat deformable elements 50 following on the action of heat will result in shorter tension bars becoming disconnected from one another. Burning structure can in the same manner as previously described fall to the ground. The advantage of shorter tension bars connected together in the manner described will be clear, in that it is then possible that higher sections of the storehouse can be saved in the event that fire breaks out in lower sections. Openings 57 in the cup-shaped elements 56 are provided for manipulation of screw-threaded nuts 62 and 66.

Figure 10:
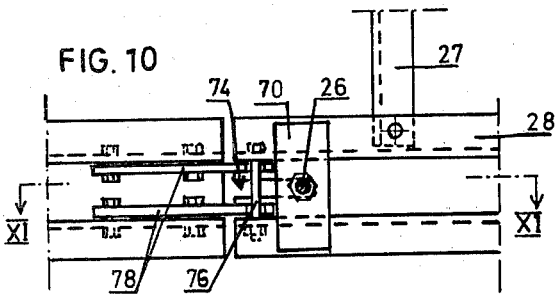
FIG. 10 shows an under-side view of ends of adjacent shelving girders at their points of support.
Figure 11:
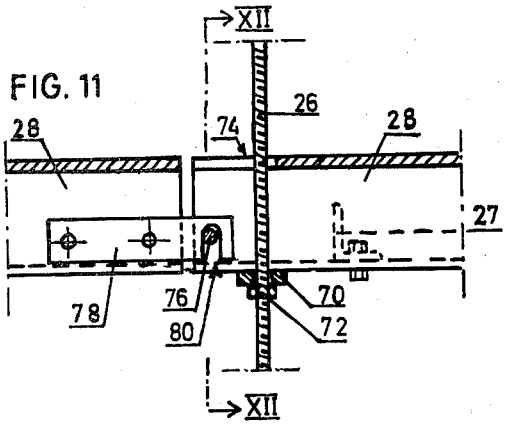
FIG. 11 shows a longitudinal vertical cross section of ends of adjacent shelving girders at their point of support.
Figure 12:
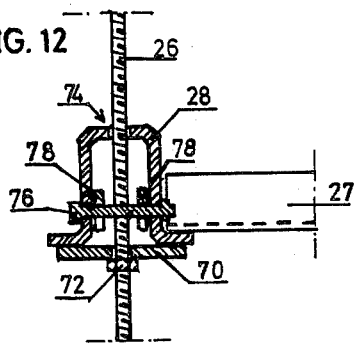
FIG. 12 shows a vertical cross section of a shelving girder taken at XII—XII of FIG. 11.

Referring to FIGS. 10 to 12 showing details of how shelving girders 28 may be mounted on tension bars 26, reference numeral 70 refers to a support element in the form of a rectangular plate. Such plates are mounted at longitudinally spaced intervals along the tension bars 26 and are supported by screw-threaded nuts 72. The shelving girders 28 are for example of inverted U-section and each shelf girder has a slot 74 into which the tension bar 26 slots so that the shelving girder 28 is supported at said one end by the rectangular plate 70. A cross bolt 76 is provided across the webs of the girder to prevent displacement of the tension bar 26 out of the vertical slot 74. The other end of the shelving girder has fish plates 78 secured to the inside surfaces of the webs, which fish plates are provided with vertical slots 80 (see FIG. 11) for slotting over the cross bolt 76. In this fashion said other end of the shelf girder may be supported by the cross bolt.

What is claimed is:

1. A suspended shelving storehouse of the highrise type in which conveyor vehicles can move between rows of shelving for performing storage activities which storehouse includes construction elements comprising a foundation, spaced apart vertical columns rising from the foundation, and a load-bearing ceiling supported by said vertical columns, and further including a series of tension bars each secured at one end to said load-bearing ceiling at spaced intervals between said vertical columns so that said tension bars are suspended substantially vertically from said ceiling between adjacent said spaced apart vertical columns with no horizontal force components acting on said construction elements, support elements mounted at longitudinally spaced intervals on each of said tension bars, and horizontally mounted shelving girders pivotally supported between adjacent said tension bars by said support elements mounted at longitudinally spaced intervals on each of said tension bars to pivot substantially in a plane parallel to said tension bars so that substantially only tensile forces are transmitted to the tension bars by loads carried by said shelving girders, said girders being free of contact with said vertical columns, each said shelving girder having a slotted end into which slot a corresponding said tension bar is inserted so that each shelving girder is supported at one end by a support element mounted on a respective said tension bar.

2. A suspended shelving storehouse according to claim 1, in which the said tension bars are additionally each secured at the other end to said foundation at spaced intervals between said vertical columns, and in which said tension bars are tensioned between said load bearing ceiling and said foundation to accommodate stretching of tension bars when the shelving girders are loaded.

3. A suspended shelving storehouse including construction elements comprising a foundation, spaced apart vertical columns rising from the foundation, and a load-bearing ceiling supported by said vertical columns, and further including a series of tension bars each secured at one end to said load-bearing ceiling at spaced intervals between said vertical columns so that said tension bars are suspended substantially vertically from said ceiling between adjacent said spaced apart vertical columns with no horizontal force components acting on said construction elements, and shelving girders mounted horizontally between adjacent said tension bars and free of supporting contact with said vertical columns, and wherein the one end of said tension bars pass through holes provided in said ceiling, and in which each said tension bar is secured to said ceiling by a respective refractory element supported on an outer side of said ceiling, said one end of each of said tension bars in turn being secured to its associated said respective refractory element, each said refractory element being destructable by an act of stricking resulting in such refractory element and those of said shelving girders mounted thereon falling.

4. A suspended shelving storehouse including construction elements comprising a foundation, spaced apart vertical columns rising from the foundation, and a load-bearing ceiling supported by said vertical columns, and further including a series of tension bars each secured at one end to said load-bearing ceiling at spaced intervals between said vertical columns so that said tension bars are suspended substantially vertically from said ceiling between adjacent said spaced apart vertical columns with no horizontal force components acting on said construction elements, and shelving girders mounted horizontally between adjacent said tension bars and free of supporting contact with said vertical columns, and wherein the one end of said tension bars pass through respective holes provided in said ceiling, and in which each of said tension bars are secured to said ceiling by a respective heat deformable element deformable in a temperature range not injurious to said building construction elements, each of said elements being supported in a respective seat mounted on said ceiling, said one end of said tension bars in turn being secured to its associated said heat deformable element and an opening being defined at the base of said seat through which said one end of its associated said tension bar may pass.

5. A suspended shelving storehouse including construction elements comprising a foundation, spaced apart vertical columns rising from the foundation, and a load-bearing ceiling supported by said vertical columns, and further including a series of tension bars each secured at one end to said load-bearing ceiling at spaced intervals between said vertical columns so that said tension bars are suspended substantially vertically from said ceiling between adjacent said spaced apart vertical columns with no horizontal force components acting on said construction elements, and shelving girders mounted horizontally between adjacent said tension bars and free of supporting contact with said vertical columns, and wherein each said tension bar consists of a series of interconnected shorter tension bars, and in which connections between said shorter tension bars are made by connection of at least one end of two adjacent ones of said shorter tension bars to a heat deformable element deformable in a temperature range not injurious to said building construction elements, each of said elements being mounted on an end of the other adjacent said shorter tension bar.

6. A suspended shelving storehouse including construction elements comprising a foundation, spaced apart vertical columns rising from the foundation, and a load-bearing ceiling supported by said vertical columns, and further including a series of tension bars each secured at one end to said load-bearing ceiling at spaced intervals between said vertical columns so that said tension bars are suspended substantially vertically from said ceiling between adjacent said spaced apart vertical columns with no horizontal force components acting on said construction elements, and shelving girders mounted horizontally between adjacent said tension bars and free of supporting contact with said vertical columns, and wherein each said heat deformable element is mounted on an end of a respective said shorter tension bar by a respective cup-shaped element into which its associated one of said heat deformable elements fits, said cup-shaped element having a top to which an end of its associated said shorter tension bar is secured, and in which a bottom of said cup-shaped element is provided with an opening through which said end of its associated said shorter tension bar which is connected to the heat deformable element may pass.

7. A suspended shelving storehouse including construction elements comprising a foundation, spaced apart vertical columns rising from the foundation, and a load-bearing ceiling supported by said vertical columns, and further including a series of tension bars each secured at one end to said load-bearing ceiling at spaced intervals between said vertical columns so that said tension bars are suspended substantially vertically from said ceiling adjacent said spaced apart vertical columns with no horizontal force components acting on said construction elements, and shelving girders mounted horizontally between adjacent said tension bars and free of supporting contact with said vertical columns, and wherein said shelving girders are mounted horizontally between adjacent said tension bars by support elements mounted at longitudinally spaced intervals on said tension bars, each said shelf girder having a slotted end into which slot a tension bar may be inserted so that each shelving girder is supported at one end by a support element mounted on a nut which is screw-threaded on a respective one of said tension bars, said slotted end additionally being provided with holes for receiving a cross bolt transversely across a respective one of said shelf girders to prevent displacement of its associated one of said tension bars out of said slot, the other end of the respective one of said shelving girders having fish plates secured thereto which have vertical bolt slots for slotting over said cross bolt, the other end being supported by said cross bolt.

* * * * *